US011450973B1

(12) United States Patent
Park et al.

(10) Patent No.: US 11,450,973 B1
(45) Date of Patent: Sep. 20, 2022

(54) ALL METAL WIDEBAND TAPERED SLOT PHASED ARRAY ANTENNA

(71) Applicant: AGENCY FOR DEFENSE DEVELOPMENT, Daejeon (KR)

(72) Inventors: Joo Rae Park, Daejeon (KR); Jeong Ho Ryu, Daejeon (KR); Young Mi Park, Daejeon (KR); Jae Won Chang, Daejeon (KR); Cheol Soo Lee, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 17/592,242

(22) Filed: Feb. 3, 2022

(30) Foreign Application Priority Data

Jul. 15, 2021 (KR) ..... 10-2021-0092882

(51) Int. Cl.
*H01Q 21/06* (2006.01)
*H01Q 1/48* (2006.01)

(52) U.S. Cl.
CPC ..... *H01Q 21/064* (2013.01); *H01Q 1/48* (2013.01)

(58) Field of Classification Search
CPC .... H01Q 13/085; H01Q 13/10; H01Q 21/064; H01Q 1/48
See application file for complete search history.

(56) References Cited

U.S. PATENT DOCUMENTS

| | | | | |
|---|---|---|---|---|
| 4,853,704 | A * | 8/1989 | Diaz | H01Q 13/085 343/770 |
| 6,414,645 | B1 * | 7/2002 | Dahlberg | H01Q 1/283 343/705 |
| 6,891,511 | B1 * | 5/2005 | Angelucci | H01Q 21/064 343/770 |
| 8,654,031 | B2 | 2/2014 | Livingston et al. | |
| 10,741,924 | B1 * | 8/2020 | McGrath | H01Q 5/30 |
| 2013/0214980 | A1 | 8/2013 | Lambert et al. | |
| 2017/0331199 | A1 * | 11/2017 | Svensson | H01Q 21/0006 |

FOREIGN PATENT DOCUMENTS

| | | | |
|---|---|---|---|
| EP | 3427342 | B1 | 2/2020 |
| JP | 2013-106301 | A | 5/2013 |
| JP | 5523197 | B | 6/2014 |
| KR | 10-2011-0116834 | A | 10/2011 |
| KR | 10-2012-0032399 | A | 4/2012 |
| KR | 10-1778595 | B | 9/2017 |
| KR | 10-2017-0116558 | A | 10/2017 |
| WO | 2016099367 | A | 6/2016 |

OTHER PUBLICATIONS

Balanis, "Antenna Theory: Analysis and Design", 2nd Edition, John Wiley & Sons, New York, preface at p. v (1997).

(Continued)

*Primary Examiner* — Hasan Islam
(74) *Attorney, Agent, or Firm* — Finch & Maloney PLLC

(57) ABSTRACT

An all metal wideband tapered slot phase array antenna includes: a ground plate; and a plurality of antennas arranged on the ground plate, wherein each of the antennas includes radiators configured to face each other with respect to a center line, forming an inclined surface that starts from the ground plate and decreases in width in an exponential manner, and having a non-uniform thickness.

14 Claims, 12 Drawing Sheets

(56) References Cited

OTHER PUBLICATIONS

Gibson, "The Vivaldi Aerial", Proceedings of the 9th European Microwave Conference, Brighton U.K., pp. 101-105 (1979).
Kindt et al., "Ultrawideband All-Metal Flared-Notch Array Radiator", IEEE Transactions on Antennas and Propagation, vol. 58, No. 11, pp. 3568-3575 (Nov. 2010).
Kindt et al., "Dual-Polarized Metal-Flare Sliced Notch Antenna Array", IEEE Transactions on Antennas and Propagation, vol. 68, No. 4, pp. 2666-2674 (Apr. 2020).
Holland et al.,"The Banyan Tree Antenna Array", IEEE Transactions on Antennas and Propagation, vol. 59, No. 11, pp. 4060-4070 (Nov. 2011).
Masters et al., "Coordinate System Plotting for Antenna Measurement", Progress in 29nd Antenna Measurement Techniques Association, pp. 449-458 (2007).
Bhattacharyya et al., "Radiation Pattern Analysis of Uniform Rectangular Planar Arrays for Millimeter Wave Communications: Comparative Study with Uniform Linear Arrays", Wireless Personal Communications, 112, pp. 827-848 (Jan. 2020).
Sharp, "A Triangular Arrangement of Planar-Array Elements that Reduces the Number Needed", IRE Transactions on Antennas and Propagation, pp. 126-129 (Mar. 1961).
Liang et al., "Inequality Condition for Grating Lobes of Planar Phased Array", Progress In Electromagnetics Research B, vol. 4, pp. 101-113 (2008).
Tianang et al., "Ultra-Wideband Lossless Cavity-Backed Vivaldi Antenna", IEEE Transactions on Antennas and Propagation, vol. 66, No. 1, pp. 115-124 (Jan. 2018).
Ostadrahimi et al., "Analysis of a Double-Layered Vivaldi Antenna Inside a Metallic Enclosure", Progress in Electromagnetic Research, vol. 143, pp. 503-518 (2013).
Abbak et al., "Microwave Breast Phantom Measurements with a Cavity-Backed Vivaldi Antenna", IET Microwaves, Antennas and Propagation, vol. 8, iss. 13, pp. 1127-1133 (2014).
Rasanna et al., "A Parametric Analysis & Design of All Metal Vivaldi Antenna Covering 3.0—18 GHz for DF and Phased Array Applications", Progress in Electromagnetics Research C, vol. 92, pp. 52-69 (2019).
Yan et al., "A Dual-Polarized 2—18-GHz Vivaldi Array for Airborne Radar Measurements of Snow", IEEE Transactions on Antennas and Propagation, vol. 64, No. 2, pp. 781-785 (Feb. 2016).

* cited by examiner $$T_A = \frac{1}{2} T_B$$

ALL METAL WIDEBAND TAPERED SLOT PHASED ARRAY ANTENNA

CROSS-REFERENCE TO RELATED APPLICATION

This application claims priority to and benefits of Korean Patent Application No. 10-2021-0092882, filed in the Korean Intellectual Property Office on Jul. 15, 2021, the entire contents of which are incorporated herein by reference.

BACKGROUND

(a) Field

Embodiments of the present invention relates to an all-metal tapered slot phased array antenna for operating at a wideband frequency.

(b) Description of the Related Art

An antenna is an important element for transmitting and receiving signals by using electromagnetic waves. A size of the antenna affects an operating frequency band, a gain, and a radiation pattern, and in general, the size of the antenna tends to be the same or larger than an operating wavelength.

A phased array antenna may have an arrayed form using one antenna, may have different characteristics from an independent single antenna by electrical influence between several antennas, and may control a radiation beam pattern and a beam steering angle by controlling a magnitude and a phase of a signal fed to each antenna.

For an array interval of the phased array antenna, as shown in Equation 1, it is common to configure the array interval such that grating lobes GL which are a function of a frequency and a beam steering angle do not occur.

$$d \leq \frac{\lambda_H}{1+\sin\theta_o} \quad \text{(Equation 1)}$$

Herein, d indicates the array interval, $\lambda_H$ indicates a wavelength of a highest operating frequency, and $\theta_o$ indicates a maximum beam steering range.

In general, as an antenna having a wideband frequency characteristic, there are a spiral antenna, a log periodic antenna, etc., and an antenna size generally tends to be large compared to the operating wavelength. However, according to Equation 1, as the frequency increases and the beam steering angle increases, the array interval becomes narrower, and thus an antenna that is large compared to the wavelength is not suitable as a phased array antenna for a system requiring a wideband and wideangle beam steering function.

The above information disclosed in this Background section is only for enhancement of understanding of the background of the invention, and therefore, it may contain information that does not form the prior art that is already known in this country to a person of ordinary skill in the art.

SUMMARY

There is a tapered slot antenna as an antenna that can be used as a phased array antenna while having a wideband frequency characteristic. The tapered slot antenna is formed to include a feeding portion in which a first plate is connected to a feeding line of a coaxial line, and a second plate is connected to a structure having a ground plane characteristic, similar to a feeding structure of the waveguide, a resonator forming a short-circuited stub electrically connected in parallel with the feeding portion, and a radiator that guides and radiates electromagnetic waves induced by the feeding portion into free space. The feeding portion of the antenna has a structure in which a first side of the radiating unit to be connected to a ground plane and a second side thereof to have a gap with respect to the ground plane, and an inner core of the coaxial line is connected to a conductor having a gap with respect to the ground plane, in order to form a balance mode. The gap with respect to the ground plane, a conductor thickness, and a position may be selected to match a characteristic impedance of the coaxial line well, the resonator may have a cavity structure in the form of a short-circuited end and may be implemented in a square, triangular, circular, or another shape, and a frequency characteristic may vary depending on a width and a length of the resonator. The radiator may realize a distance between two conductors in a straight line, exponentially, or another shape, and may guide an electromagnetic wave induced from the feeding portion to an antenna hole surface to radiate it into a free space.

A tapered slot antenna may be implemented by using a printed circuit board (PCB) or an all-metal material, and in the case of the all-metal material, loss due to a dielectric material of the PCB is small. It is known that in an all metal tapered slot antenna, the longer the antenna has the more advantageous of the wideband frequency characteristic, and the shorter the antenna has the better the polarization characteristic of the antenna.

Embodiments of the present invention has been made in an effort to provide an all metal wideband tapered slot phased array antenna having a short length while having low loss and wideband frequency characteristics.

An embodiment of the present invention provides an all metal wideband tapered slot phased array antenna including: a ground plate; and a plurality of antennas arranged on the ground plate, wherein each of the antennas includes radiators configured to face each other with respect to a center line, forming an inclined surface that starts from the ground plate and decreases in width in an exponential manner, and having a non-uniform thickness.

A thickness of the radiators may decrease exponentially from the ground plate toward an end thereof.

The thickness of the radiators may have a symmetrical shape with respect to a center line.

The width of the end of the radiators may be half of a thickness of the end of the radiators.

Each of the antennas may further include: a resonator configured to share a side thereof with the ground plate; a feeding portion that forms a continuous inclined surface with an inclined surface of the radiator, is spaced apart from the ground plate by a gap, and excites a feeding signal; and a feeding line connected to the radiator through the feeding portion to apply the feeding signal to the radiator.

The antennas may be arranged in one direction, and a radiator having the resonator and a radiator not having the resonator contact each other between neighboring antennas.

The resonator of the radiator having the resonator may be extended to the neighboring radiator.

The antennas may be two-dimensionally arranged in an orthogonal direction, four radiators may be coupled such that opposite surfaces of inclined surfaces thereof are in contact with each other to be integrated in a + shape in a top view, and the four radiators may share each other by a width of an end thereof.

The width of the end of the radiators may be half of a thickness of the end of the radiators.

A protruding guide portion may be formed at a lower end of the radiators, and an intaglio hole may be formed in the ground plate to allow the guide portion to be inserted thereto.

Another embodiment of the present invention provides an all metal wideband tapered slot phased array antenna including: a ground plate; and a plurality of radiators two-dimensionally arranged on the ground plate in an orthogonal direction, wherein each of the radiators forms an inclined surface that starts from the ground plate and decreases in width in an exponential manner, and has a non-uniform thickness.

A thickness of each of the radiators may decrease exponentially from the ground plate toward an end thereof.

The thickness of each of the radiators may have a symmetrical shape with respect to a center line.

The width of the end of each of the radiators may be half of a thickness of the end of each of the radiators.

The all metal wideband tapered slot phase array antenna may further include: a resonator configured to share a side thereof with the ground plate; a feeding portion that forms a continuous inclined surface with an inclined surface of a radiator, is spaced apart from the ground plate by a gap, and excites a feeding signal; and a feeding line connected to the radiator through the feeding portion to apply the feeding signal to the radiator.

Four radiators may be coupled such that opposite surfaces of inclined surfaces thereof are in contact with each other to be integrated in a + or × shape in a top view, the four radiators may share each other by a width of an end thereof, and a protruding guide portion may be formed at a lower end of a center in a coupled structure of the four radiators.

According to the embodiment of the present invention, the conductor broadband tapered slot phased array antenna may have a wideband operating frequency characteristic while reducing the length of the antenna.

More extended wideband frequency characteristics may be implemented by using a structure having a variable antenna thickness. The length of the antenna may be reduced by forming a starting point of the radiator on the ground plane, connecting the feeding portion and the resonator at the ground plane, and sharing one side of the resonator with the ground plane.

In addition, when an array antenna is configured, a frequency range may be further extended by extending the length of the resonator to the neighboring antenna.

An opening area of the antenna may be maximized by halving a relationship between a thickness and a width of the conductor of the opening of the antenna and sharing each certain portion of the antenna.

DETAILED DESCRIPTION

Embodiments of the present invention will be described more fully hereinafter with reference to the accompanying drawings, in which embodiments of the invention are shown. As those skilled in the art would realize, the described embodiments may be modified in various different ways, all without departing from the spirit or scope of the present invention.

To clearly describe the present invention, parts that are irrelevant to the description are omitted, and like numerals refer to like or similar constituent elements throughout the specification.

In addition, unless explicitly described to the contrary, the word □comprise□ and variations such as □comprises□ or □comprising□ will be understood to imply the inclusion of stated elements but not the exclusion of any other elements.

Hereinafter, a basic structure of an all metal wideband tapered slot phased array antenna according to an embodiment of the present invention will be described with reference to FIG. 1 to FIG. 6.

Figure 1:
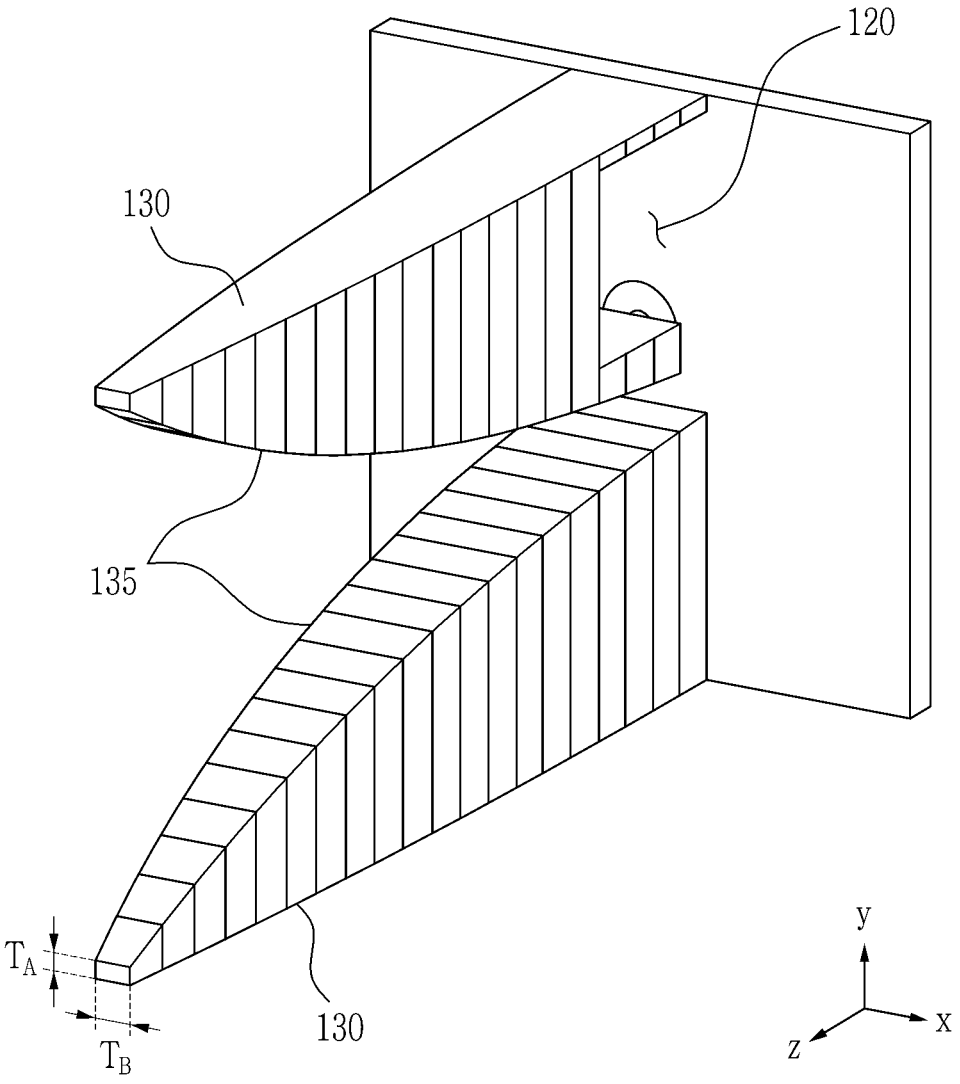
FIG. 1 illustrates a perspective view showing a basic structure of an all metal wideband tapered slot phased array antenna according to an embodiment of the present invention.
Figure 2:
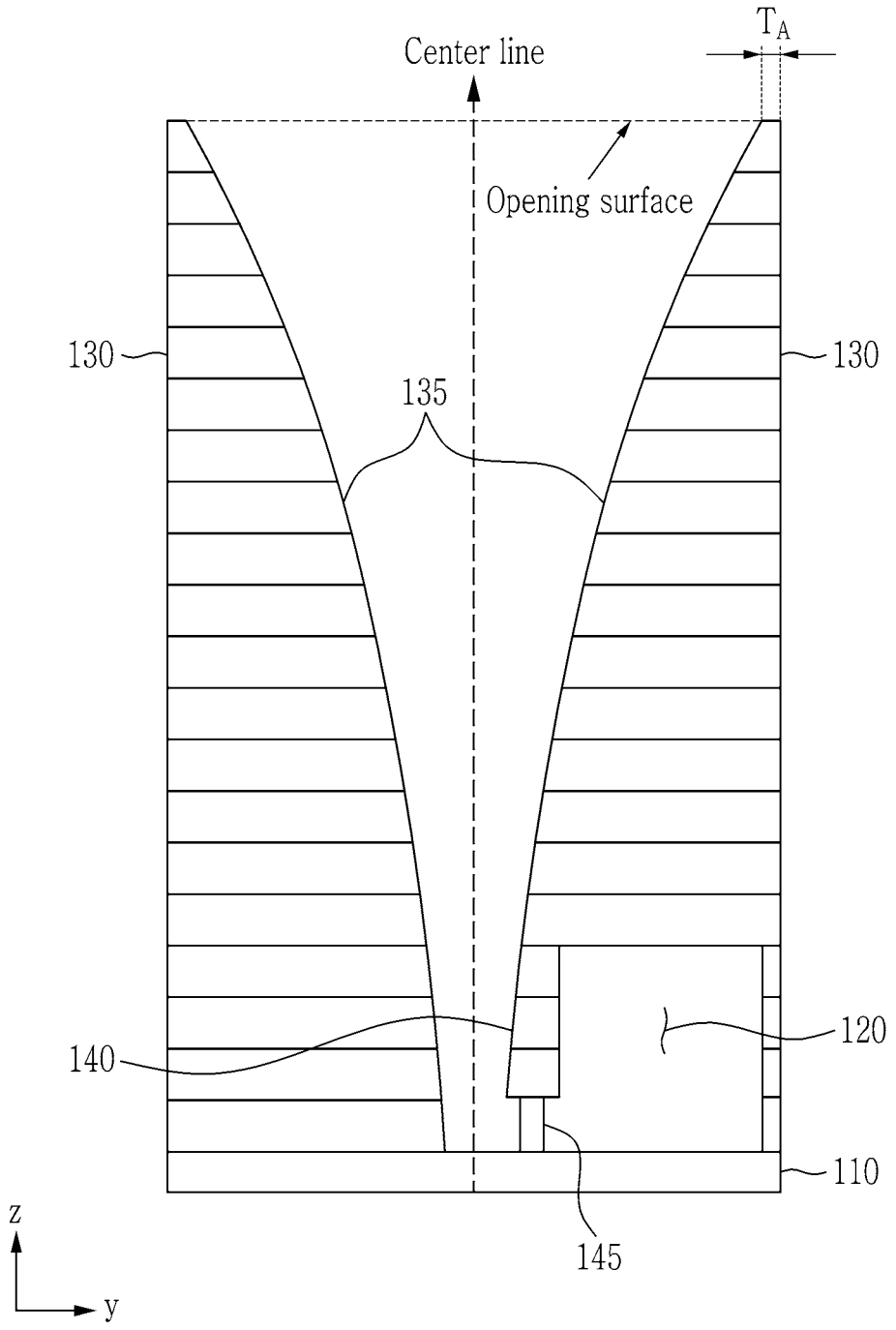
FIG. 2 illustrates a side view of the antenna of FIG. 1 viewed in an x-axis direction.
Figure 3:
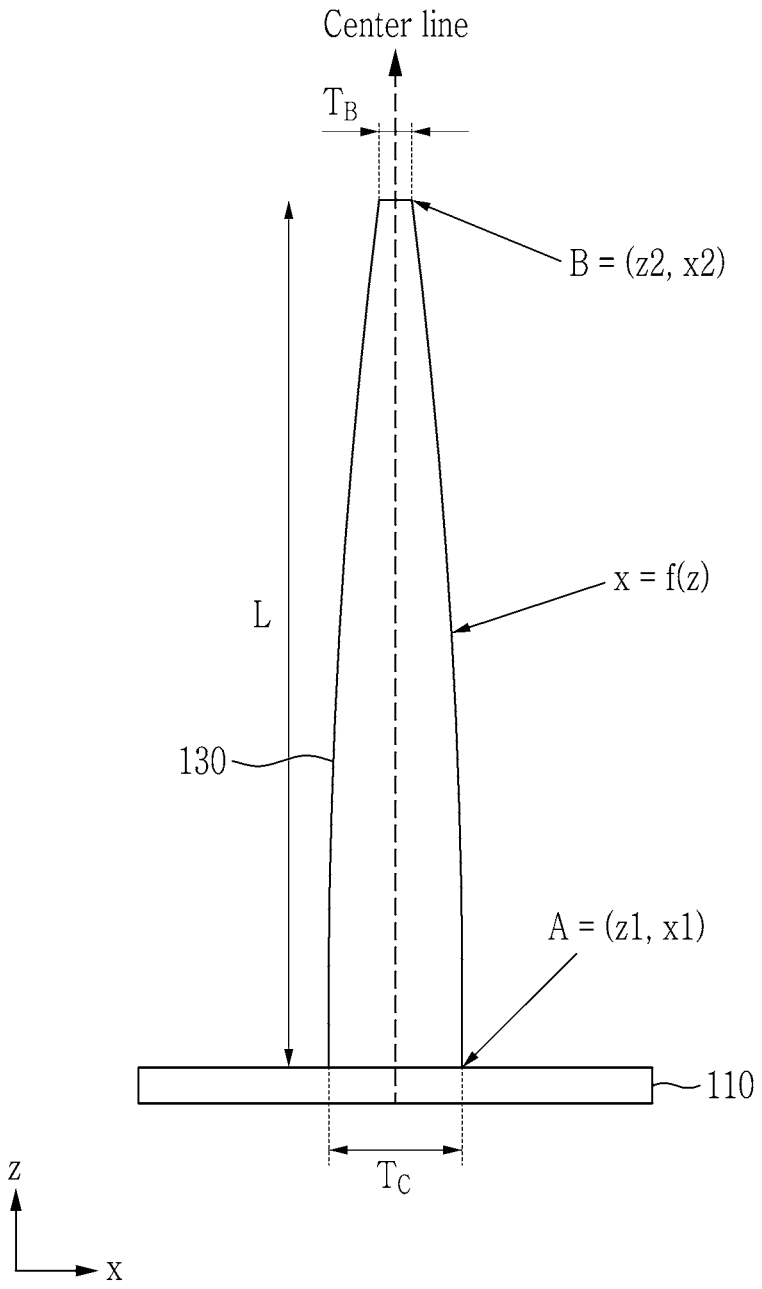
FIG. 3 illustrates a side view of the antenna of FIG. 1 viewed in a y-axis direction.
Figure 4:
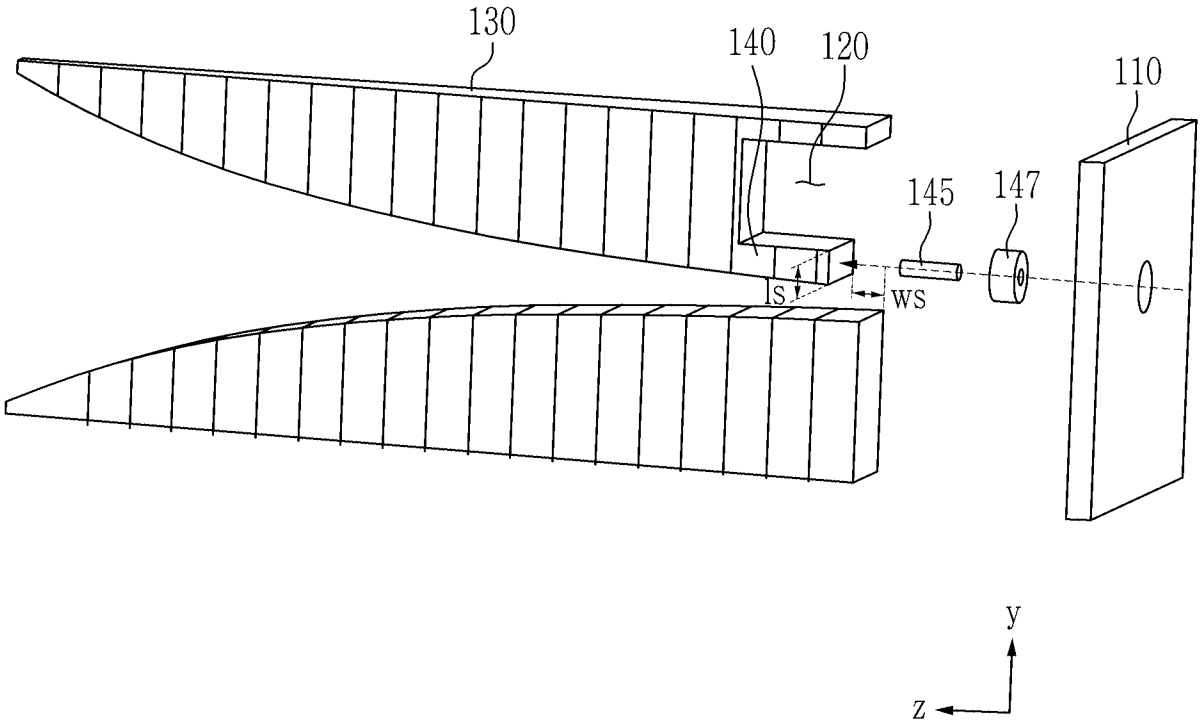
FIG. 4 and FIG. 5 each illustrate an exploded view for describing a feeding portion and a resonator in the antenna of FIG. 1.
Figure 5:
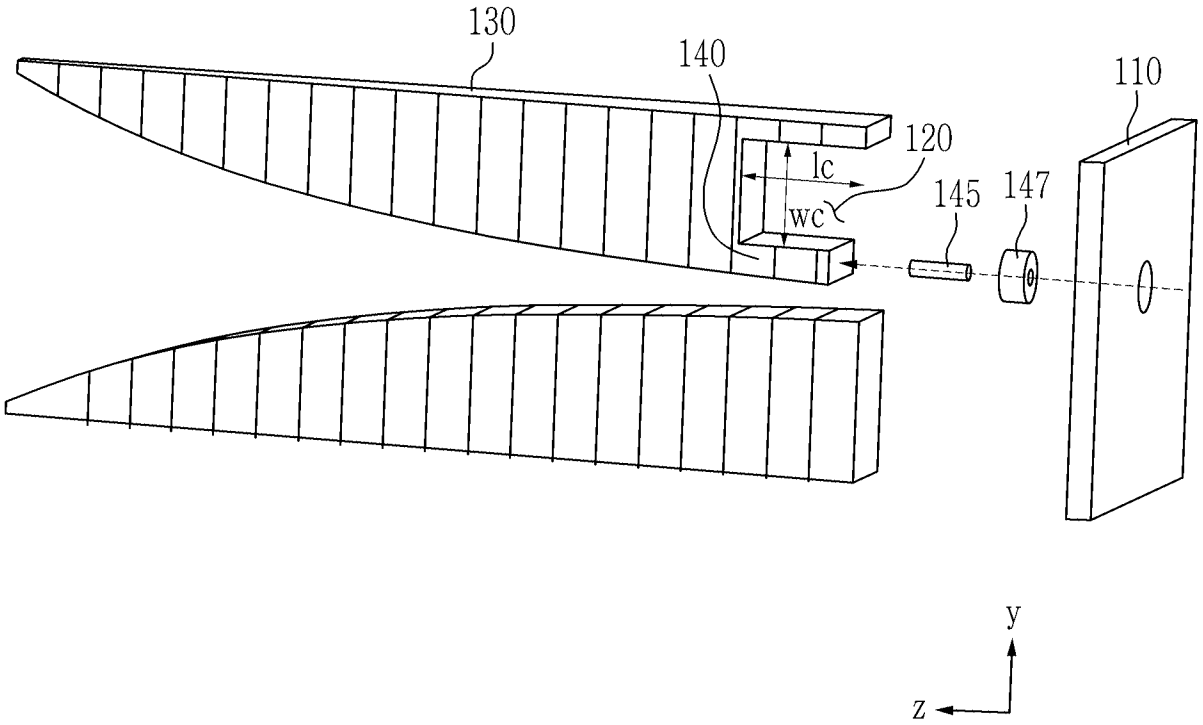
Figure 6:
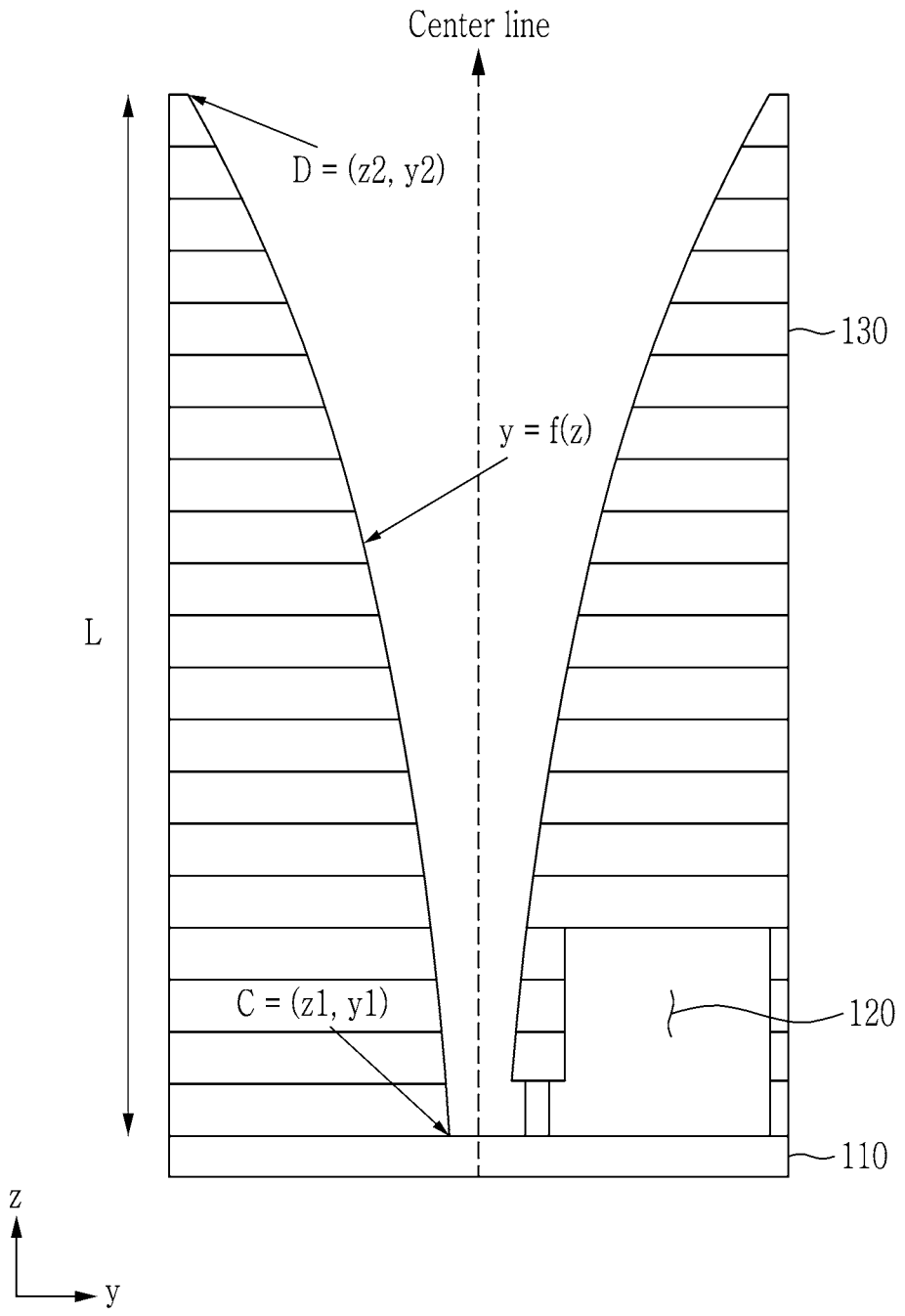
FIG. 6 illustrates a side view for describing a radiator in the antenna of FIG. 1.

FIG. 1 illustrates a perspective view showing a basic structure of an all metal wideband tapered slot phased array antenna according to an embodiment of the present invention. FIG. 2 illustrates a side view of the antenna of FIG. 1 viewed in an x-axis direction. FIG. 3 illustrates a side view of the antenna of FIG. 1 viewed in a y-axis direction. FIG. 4 and FIG. 5 each illustrate an exploded view for describing a feeding unit and a resonator in the antenna of FIG. 1. FIG. 6 illustrates a side view for describing a radiator in the antenna of FIG. 1.

Referring to FIG. 1 to FIG. 6, the all metal broadband tapered slot phased array antenna includes a ground plate 110, a resonator 120, and a plurality of antennas.

One antenna may be made of an all metal and includes two radiators 130 having a non-uniform characteristic of a non-uniform thickness (width), and the two radiators 130 may face each other based on a center line. In more detail, each of the radiators 130 may form an inclined surface 135 having a width that is decreases in an exponential form starting from the ground plate 110, and the exponentially inclined surfaces 135 of the two radiators 130 may face each other with respect to the center line. The radiators 130 may have a symmetrical structure with respect to the center line. As a distance from the ground plate 110 (ground plane) increases (toward the opening surface), a distance between the radiators 130 may gradually increase, and an y-directional width of the radiators 130 may gradually decrease, so that a width $T_A$ of an end of the radiators 130 at the opening surface may be the smallest.

The radiators 130 facing each other form the opening surface. The opening surface, which is a virtual surface connecting the radiators 130 facing each other, may indicate a portion where the radiators 130 come into contact with the free space.

A feeding portion 140 is formed in one of the two radiators 130. The feeding portion 140 is a portion in which a signal fed from a feeding line 145 is excited. The feeding portion 140 may form a continuous inclined surface with the inclined surface 135 of the radiator 130, and may be spaced apart from the ground plate 110 by a gap. The feed line 145 is connected to a coaxial line, and may be connected to one radiator 130 through the feed portion 140. The feeding line 145 transmits a fed signal applied through the coaxial line to the radiator 130 through the feeding portion 140, and the radiator 130 guides the fed signal to the opening surface.

The resonator 120 shares one side with the ground plate (or ground plane) 110. The resonator 120 may have a rectangular shape when viewed from a side surface. A shape of the resonator 120 may be formed as a slot of various shapes such as a semicircle or a triangle in addition to a quadrangle. The resonator 120 has a short stub shape that is electrically connected in parallel to the feeding line 145, and serves to extend a frequency bandwidth.

As illustrated in FIG. 3, a thickness of the radiator 130 in the x-axis direction has a non-uniform shape. A thickness of the radiator 130 may decrease exponentially from the ground plate 110 toward an end thereof. When the thickness of the radiator 130 in the x-axis direction is a thickness $T_C$ at a first portion thereof that is in contact with the ground plate 110 and a thickness $T_B$ at a second portion of an end of the radiator 130, the thickness $T_B$ at the second portion may be smaller than the thickness $T_C$ at the first portion. That is, a thickness ratio $T_B/T_C$ of the second portion to the first portion of the radiator 130 may be less than 1. The thickness of the radiator 130 in the x-axis direction may have a symmetrical shape with respect to the center line.

When the thickness of the radiator 130 in the x-axis direction is x, the thickness of the radiator 130 may be a function f(z) with respect to the z-axis direction, and may be defined as in Equation 2.

$$x=C_3e^{Rz}+C_4$$

$$C_3=(x_2-x_1)/e^{Rz2}-e^{Rz1})$$

$$C_4=(x_1e^{Rz0}-x_2e^{Rz1})/(e^{Rz2}-e^{Rz1}) \quad \text{(Equation 2)}$$

Herein, R represents an exponent of an exponent function as an expansion coefficient.

As such, the antenna 130 may have a non-uniform thickness by using an exponential function, thereby reducing a length L of the radiator and implementing a wide frequency band characteristic. This will be described later with reference to FIG. 11 and FIG. 12.

As illustrated in FIG. 4, the feeding portion 140 is formed in the radiator 130 in which the resonator 120 is formed, and the feeding line 145 is directly connected to the feeding portion 140 so that a signal of the coaxial line may be applied. The other radiator 130 of the antenna has a structure connected to (contacting) the ground plate 110. With this structure, a balance mode may be excited. To this end, a portion (ws length and Is width) of the radiator 130 corresponding to one corner of the resonator 120 is removed to be spaced apart from the ground plate 110, and the feeding line 145 may be in contact with the feeding portion 140 (the radiator 130) in the portion (gap) from which the radiating part 130 is removed. The feeding line 145 may extend through the hole formed in the ground plate 110 to be connected to the power feeding portion 140, and a dielectric 147 may be positioned between the feeding line 145 and the ground plate 110 to prevent the ground plate 110 from directly contacting the feeding line 145.

This structure has an effect that does not require an additional converter (balance-to-unbalance (BALUN)) for converting from an unbalance mode to a balanced mode.

For impedance matching with the coaxial line, initial values such as an area of the radiator 130 connected to the feeding line 145 and a length of the feeding line 145 may be set by using an impedance relationship of a flat waveguide.

As illustrated in FIG. 5, the resonator 120 may have a rectangular shape with one side shared with the ground plate 110 (ground plane). The resonator unit 120 electrically connected in parallel to the feeding line 145 may be designed to have various structures such as a rectangle, a triangle, a semicircle, and the like, and the resonator 120 having the rectangular structure is exemplified here.

The feeding line 145 is positioned at an edge of one side of the resonator 120, and as one side of the resonator 120 is shared with the ground plate 110, the length L (length in the z-axis direction) of the radiator 130 may be reduced.

In addition, the frequency characteristic of the antenna may be extended by adjusting a width we and a length Ic of the resonator 120.

As illustrated in FIG. 6, the radiator 130 may be formed in an exponential form starting from a starting point C of the ground plate 110 to an ending point D. As the starting point C of the radiator 130 is positioned on the ground plate 110, the length L of the radiator 130 may be reduced.

Hereinafter, a structure in which antennas 130 is arranged in an all metal wideband tapered slot phased array antenna according to an embodiment of the present invention will be described with reference to FIG. 7 to FIG. 10.

Figure 7:
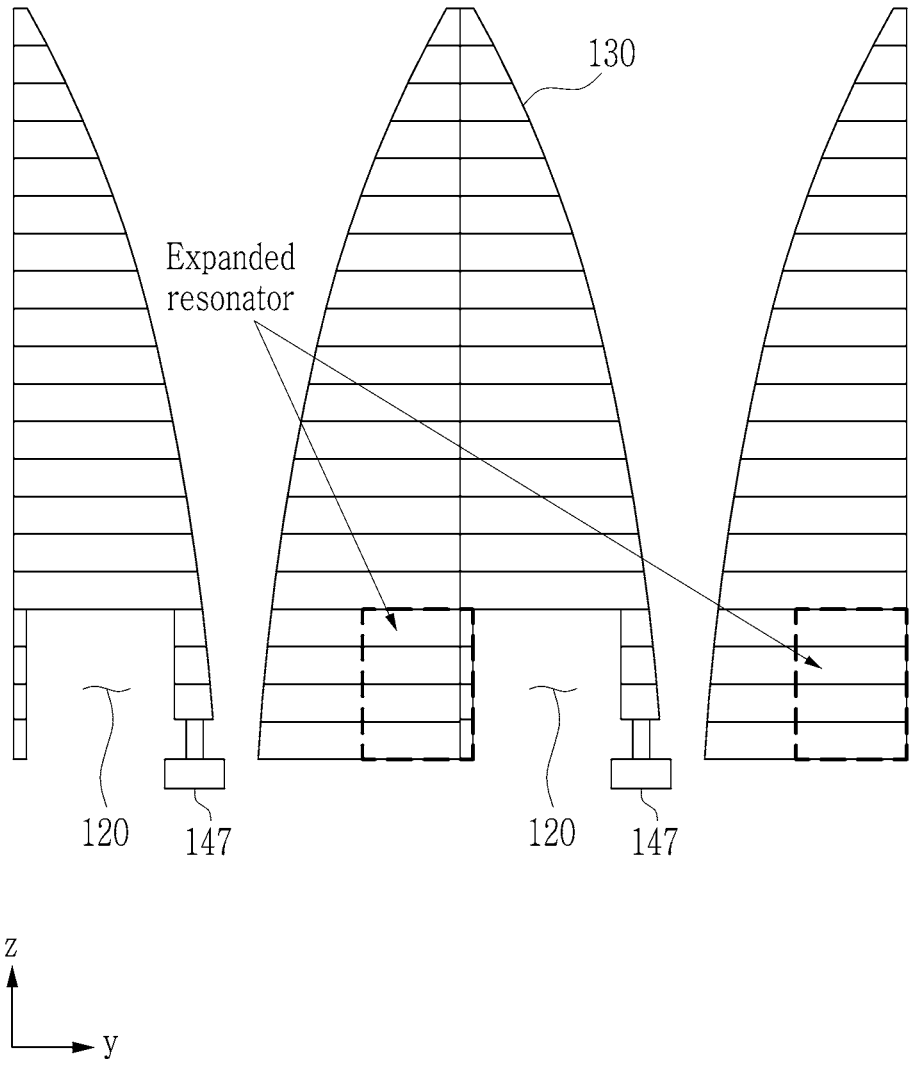
FIG. 7 illustrates a side view showing a structure of a phased array antenna in which a plurality of antennas of FIG. 1 are arranged in a direction.
Figure 8:
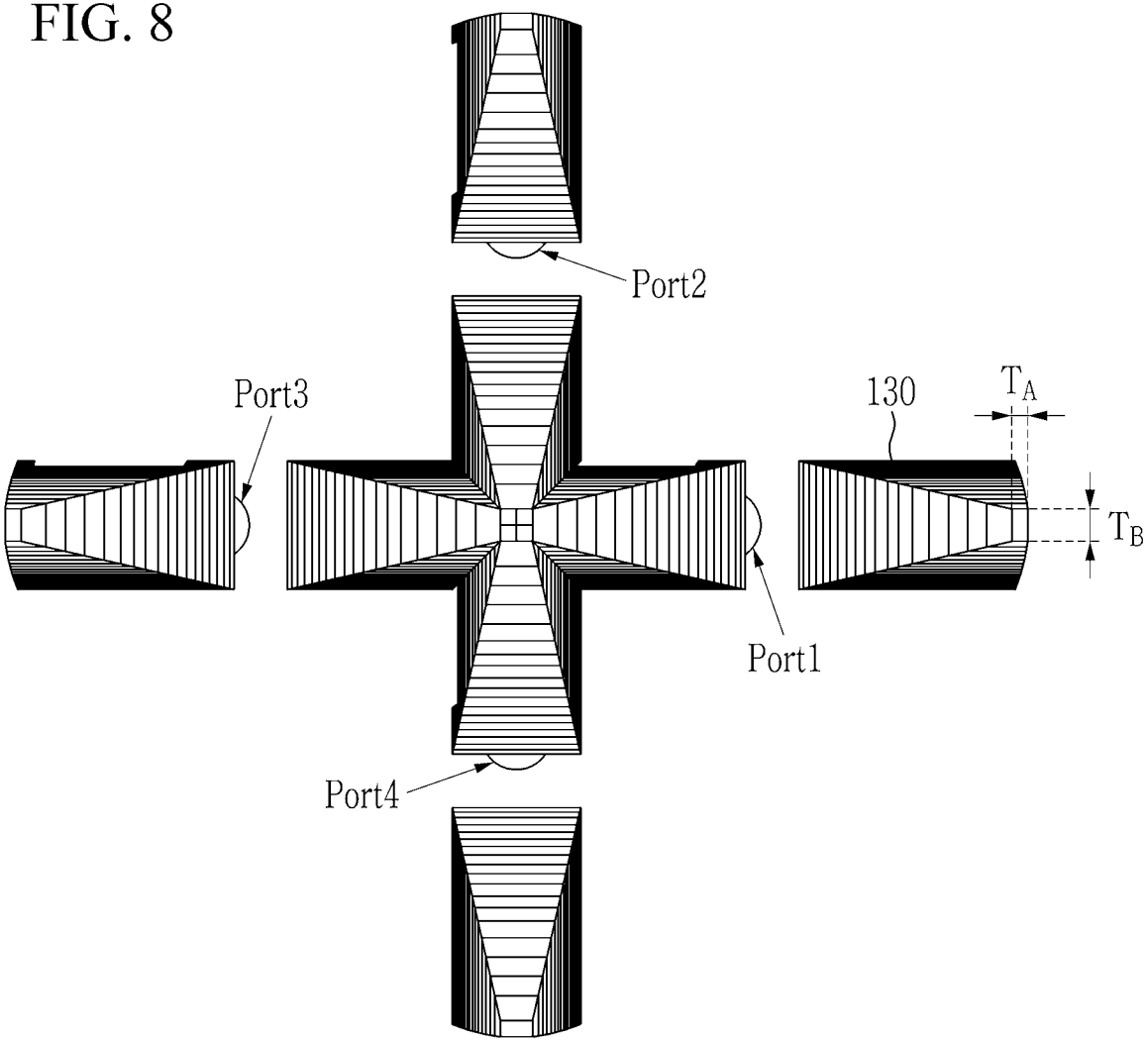
FIG. 8 illustrates a top plan view showing a structure of a phased array antenna in which a plurality of antennas of FIG. 1 are arranged in intersecting directions.
Figure 9:
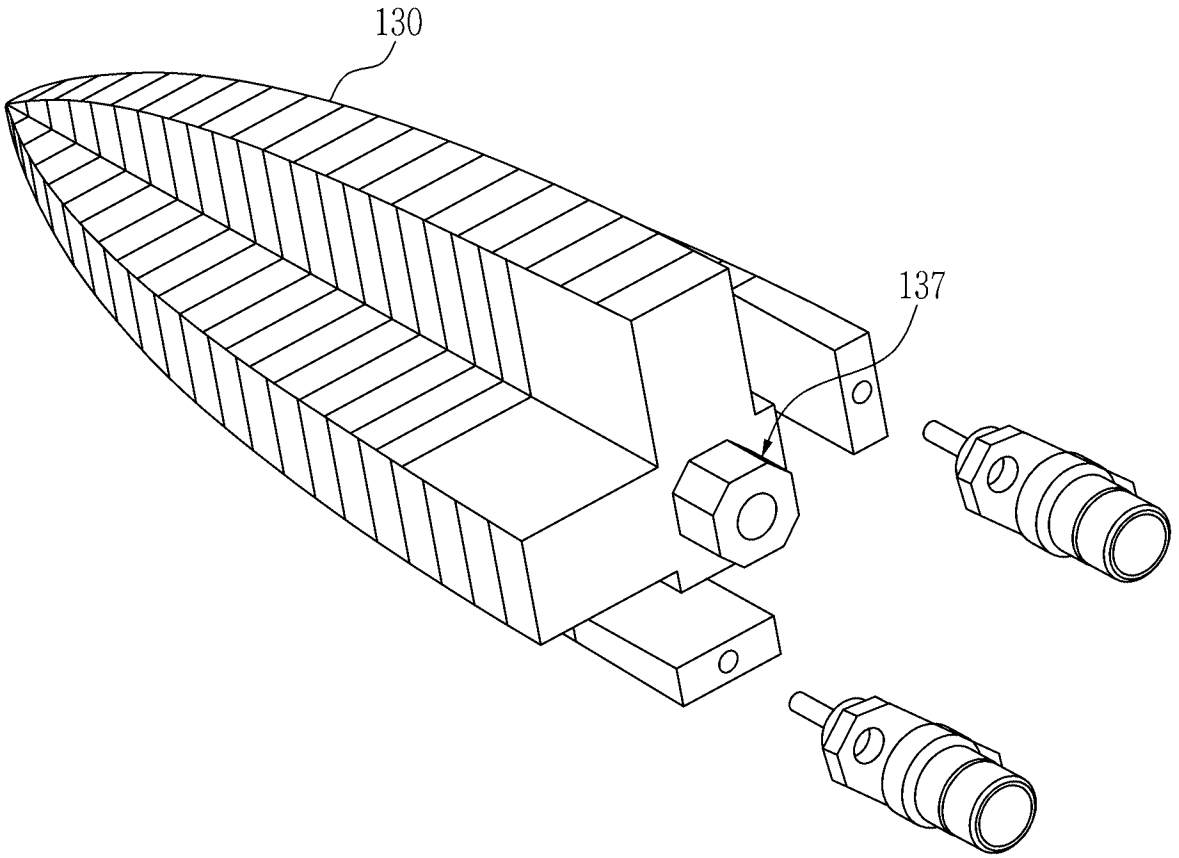
FIG. 9 illustrates a perspective view illustrating a structure of an antenna having an induction unit for precise disposal when assembling the phased array antenna of FIG. 8 with a ground plate
Figure 10:
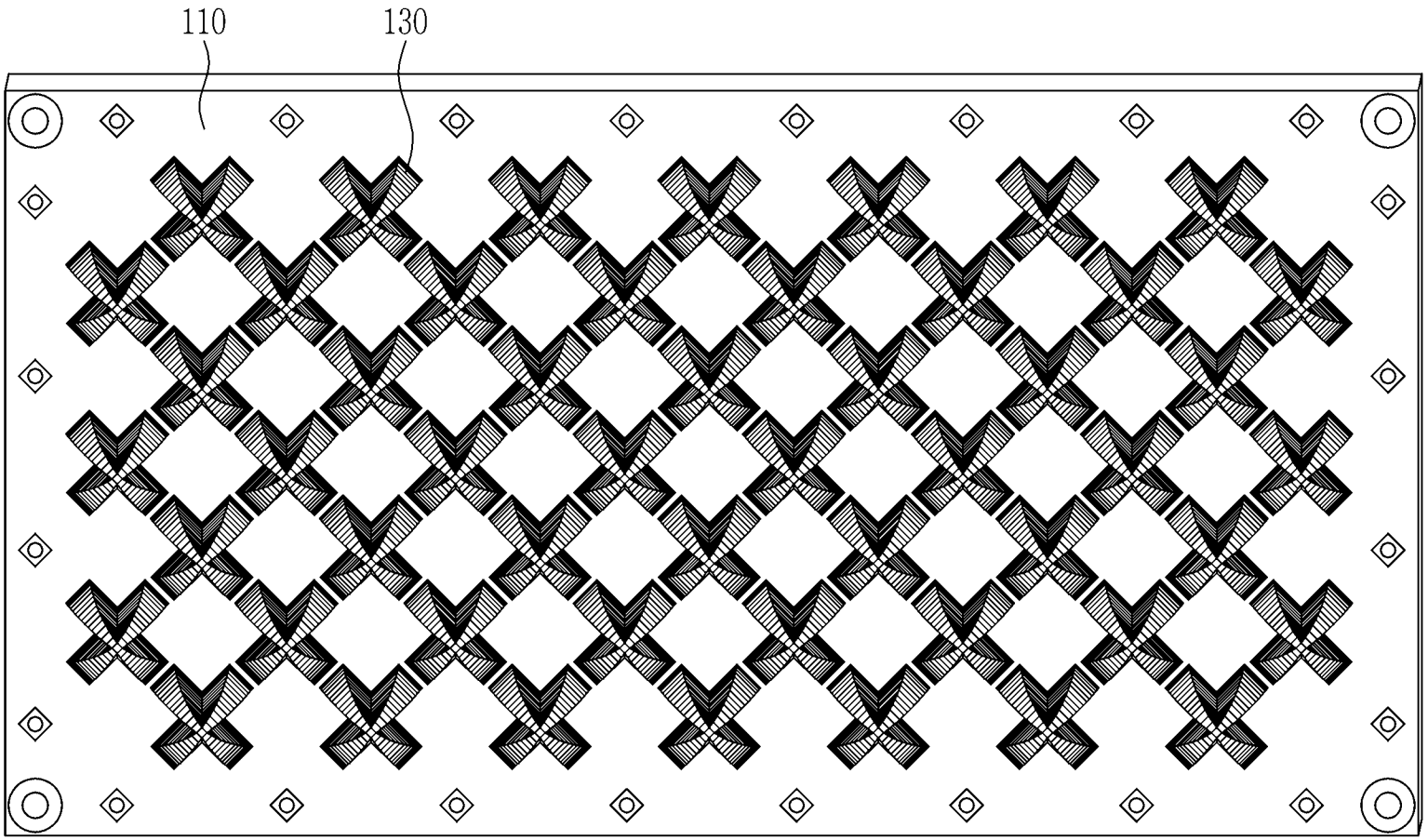
FIG. 10 illustrates a top plan view showing a phased array antenna in which the antenna of FIG. 9 is two-dimensionally arranged on a ground plate.

FIG. 7 illustrates a side view showing a structure of a phased array antenna in which a plurality of antennas of FIG. 1 are arranged in a direction. FIG. 8 illustrates a top plan view showing a structure of a phased array antenna in which a plurality of antennas of FIG. 1 are arranged in intersecting directions. FIG. 9 illustrates a perspective view illustrating a structure of an antenna having an induction unit for precise disposal when assembling the phased array antenna of FIG. 8 with a ground plate. FIG. 10 illustrates a top plan view showing a phased array antenna in which the antenna of FIG. 9 is two-dimensionally arranged on a ground plate.

As illustrated in FIG. 7, a plurality of antennas (or radiators 130) may be arranged in one direction (e.g., the y-axis direction). In this case, the radiator 130 having the resonator 120 and the radiator 130 not having the resonator 120 may contact each other between the neighboring antennas. In this case, the resonator 120 may be formed to extend to the neighboring radiator 130, and the frequency characteristic may be changed depending on a magnitude of the resonator 120.

In addition, a direction or a radiation pattern of a main beam to be emitted can be controlled by controlling a magnitude, a phase, etc., of a signal fed to each of the antennas.

As illustrated in FIG. 8, the radiators 130 (antennas) are two-dimensionally arranged in an intersecting direction (orthogonal direction, x-axis direction, and y-axis direction) to constitute a phased array antenna implementing a dual polarization characteristic. In this case, four radiators 130 may be coupled such that opposite surfaces of the inclined surfaces 135 are in contact with each other to be integrated in a + shape or an × shape in a top view, and a width $T_A$ of ends of the radiators 130 may be half of a thickness $T_B$ of the ends of the radiators 130 to have a structure in which the four integrated radiators 130 share each other as much as the width $T_A$ of the ends.

The direction and the radiation pattern of the main beam radiated may be controlled by controlling the magnitude and the phase of the signal fed to each antenna.

For example, when signals having a same signal amplitude and a phase difference of 90° to each other are simultaneously fed to Port 1 of a first antenna and port 2 of the second antenna adjacent to the first antenna, a signal with a circular polarization characteristic may be transmitted. In addition, when in-phase or reverse-phase signals are simultaneously fed to Port 1 and Port 2, a signal with a linearized polarization characteristic of a direction of ±45° may be transmitted. When a signal is fed to only one of Port 1 and Port 2, the signal with the polarization characteristic of the fed antenna direction may be transmitted, and when a magnitude of the fed signal is different and the phase difference is 90°, the signal with the elliptical polarization characteristic may be transmitted.

That is, various polarizations such as linear polarization, ±45° slant polarization, elliptical polarization, and circular polarization may be implemented depending on a double polarization antenna structure and a signal characteristic fed to the antenna.

As illustrated in FIG. 9, a guide portion 137 such as a triangle, a square, or a cuboid may be formed at a lower end of the radiator 130, so as to position the antenna 130 at an accurate and precise position when assembling it with the ground plate 110. The guide portion 137 may have a shape protruding from a lower center of the coupled structure of the four radiators 130. An intaglio hole may be formed in the ground plate 110 to allow the guide portion 137 to be inserted thereto. An effect of forming a guide line for precise arrangement of a plurality of antennas may be obtained by using the guide portion 137 and the hole of the ground plate 110.

As illustrated in FIG. 10, a plurality of antennas (or radiators 130) may be two-dimensionally arranged on the ground plate 110 in intersecting directions to form an all metal wideband tapered slot phased array antenna.

Hereinafter, an active reflection characteristic of an all metal wideband tapered slot phased array antenna according to an embodiment of the present invention will be described with reference to FIG. 11 and FIG. 12.

Figure 11:
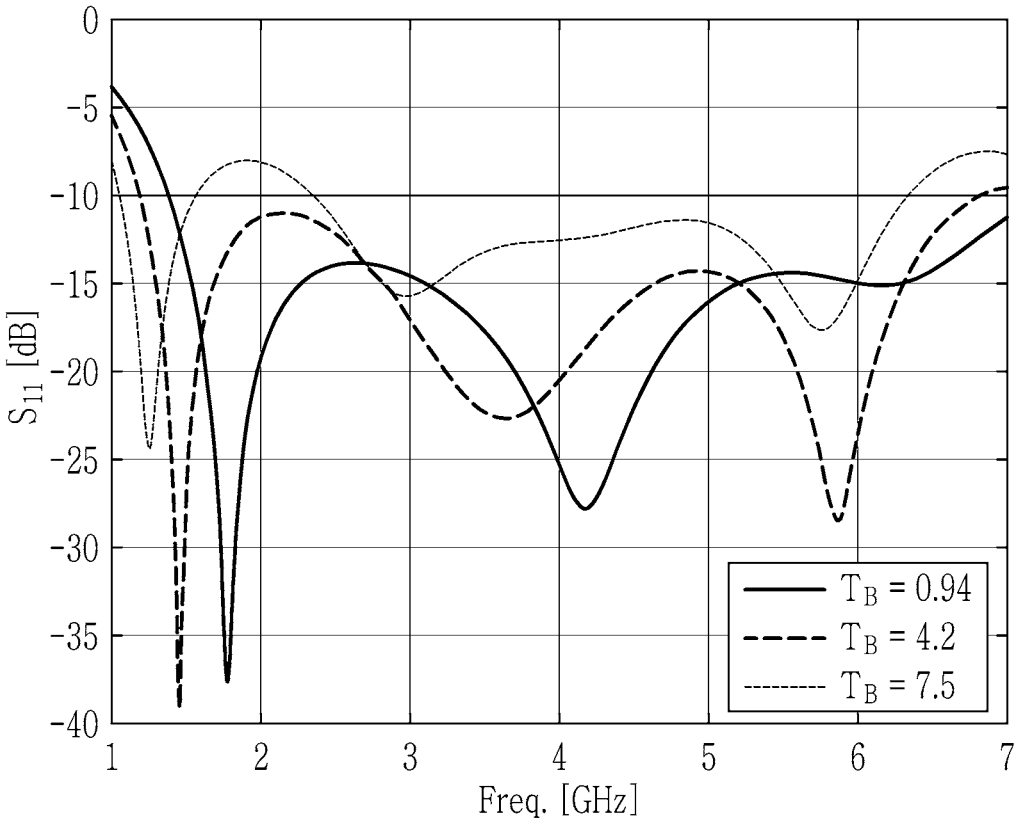
FIG. 11 illustrates a graph showing a computational analysis result of an active reflection characteristic of an antenna thickness in an all metal wideband tapered slot phased array antenna according to an embodiment of the present invention.

FIG. 11 illustrates a graph showing a computational analysis result of an active reflection characteristic of a thickness of the radiator 130 in an all metal wideband tapered slot phased array antenna according to an embodiment of the present invention.

Referring to FIG. 11, there are results of computational analysis of active reflection characteristics for the antenna positioned in the middle of an array antenna for cases where the thickness of the radiator 130 is constant and non-uniform.

In general, a frequency bandwidth of the antenna is selected as a frequency range that satisfies S11≤−10 dB, and thus active reflection characteristics are shown for a case where the thickness $T_B$ of the tip of the radiating part 130 is 0.94 mm, 4.2 mm, and 7.5 mm, respectively, when the thickness $T_C$=7.5 mm in the first portion where the radiator 130 contacts the ground plate 110. It can be seen that a case where the thickness of the radiator 130 is non-uniform ($T_B$=0.94 mm, $T_B$=4.2 mm) exhibits a wider frequency band characteristic compared to a case where the thickness of the radiator 130 is uniform ($T_B$=7.5 mm).

Figure 12:
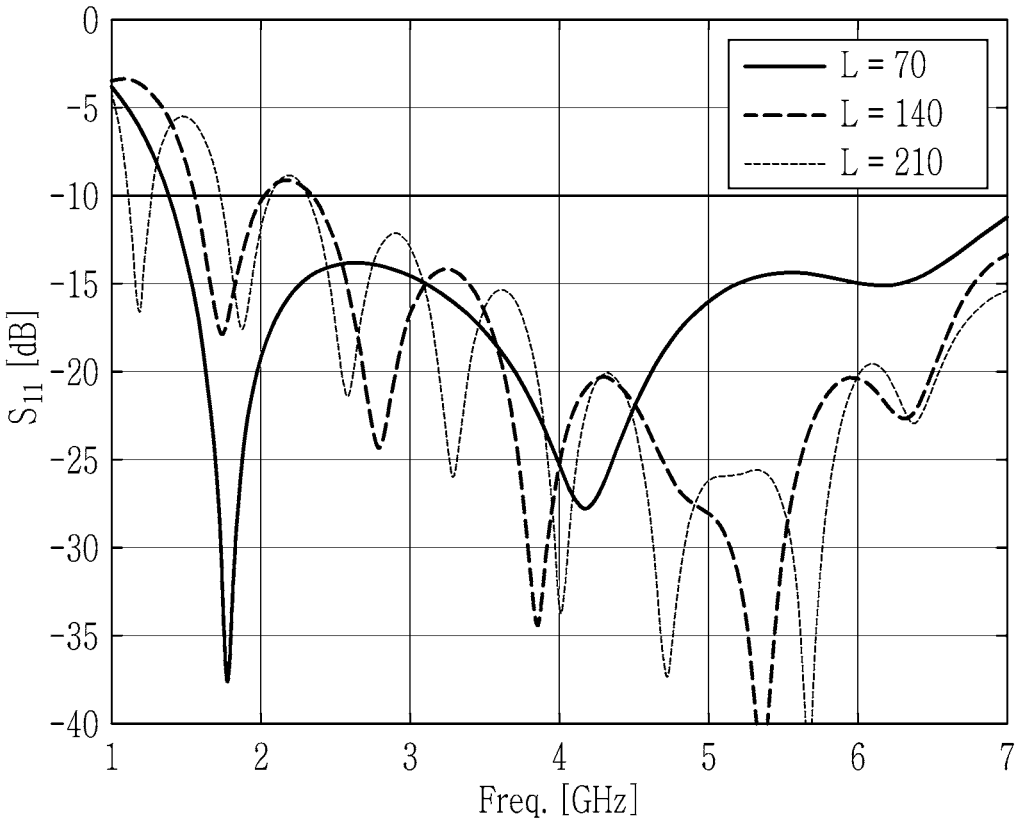
FIG. 12 illustrates a graph showing a computational analysis result of an active reflection characteristic of an antenna length in an all metal wideband tapered slot phased array antenna according to an embodiment of the present invention.

FIG. 12 illustrates a graph showing a computational analysis result of an active reflection characteristic of a length of a radiator in an all metal wideband tapered slot phased array antenna according to an embodiment of the present invention.

Referring to FIG. 12, it can be seen that even when the length L of the radiator 130 is short, the low active reflection characteristic may be implemented, by linking with the feeding portion 140 at one corner of the resonator 120 so that the radiator 130 starts from the ground plate 110 and by allowing one side of the resonator 120 to be shared with the ground plate 110 according to an embodiment of the present invention.

While embodiments of the present invention have been particularly shown and described with reference to the accompanying drawings, the specific terms used herein are only for the purpose of describing the invention and are not intended to define the meanings thereof or be limiting of the scope of the invention set forth in the claims. Therefore, a person of ordinary skill in the art will understand that various modifications and other equivalent embodiments of the present invention are possible. Consequently, the true technical protective scope of the present invention must be determined based on the technical spirit of the appended claims.

What is claimed is:

1. An all metal wideband tapered slot phased array antenna comprising:

a ground plate; and a plurality of antennas arranged on the ground plate, wherein each of the antennas includes radiators configured to face each other with respect to a center line, forming an inclined surface that starts from the ground plate and decreases in width in an exponential manner, and having a non-uniform thickness; and wherein the antennas are arranged in one direction, and a first radiator among the radiators having a resonator and a second radiator among the radiators not having any resonator contact each other between neighboring antennas.

2. The all metal wideband tapered slot phased array antenna of claim 1, wherein a thickness of the radiators decreases exponentially from the ground plate toward an end thereof.

3. The all metal wideband tapered slot phased array antenna of claim 2, wherein the thickness of the radiators has a symmetrical shape with respect to the center line.

4. The all metal wideband tapered slot phased array antenna of claim 2, wherein a width of the end of the radiators is half of a thickness of the end of the radiators.

5. The all metal wideband tapered slot phased array antenna of claim 1, wherein each of the antennas further includes:

a feeding portion that forms a continuous inclined surface with an inclined surface of the first radiator, is spaced apart from the ground plate by a gap, and excites a feeding signal; and a feeding line connected to the first radiator through the feeding portion to apply the feeding signal to the first radiator.

6. The all metal wideband tapered slot phased array antenna of claim 1, wherein the resonator of the first radiator is extended to a neighboring radiator among the radiators.

7. The all metal wideband tapered slot phased array antenna of claim 1, wherein the antennas are two-dimensionally arranged in an orthogonal direction, four radiators of each of the antennas are coupled such that opposite surfaces of inclined surfaces thereof are in contact with each other to be integrated in a + shape in a top view, and the four radiators share each other by a respective width of an end thereof.

8. The all metal wideband tapered slot phased array antenna of claim 7, wherein the respective width of the end of the four radiators is half of a thickness of the end of the four radiators.

9. The all metal wideband tapered slot phased array antenna of claim 7, wherein a protruding guide portion is formed at a lower end of the four radiators, and an intaglio hole is formed in the ground plate to allow the guide portion to be inserted thereto.

10. An all metal wideband tapered slot phased array antenna comprising:

a ground plate; and a plurality of radiators two-dimensionally arranged on the ground plate in an orthogonal direction, wherein each of the radiators forms an inclined surface that starts from the ground plate and decreases in width in an exponential manner, and has a non-uniform thickness, wherein four radiators of the plurality of radiators are coupled such that opposite surfaces of inclined surfaces thereof are in contact with each other to be integrated in a + or × shape in a top view, the four radiators share each other by a respective width of an upper end thereof, and a protruding guide portion is formed at a lower end of a center in a coupled structure of the four radiators.

11. The all metal wideband tapered slot phased array antenna of claim 10, wherein the non-uniform thickness of each of the four radiators decreases exponentially from the ground plate toward the upper end thereof.

12. The all metal wideband tapered slot phased array antenna of claim 11, wherein the non-uniform thickness of each of the four radiators has a symmetrical shape with respect to a center line.

13. The all metal wideband tapered slot phased array antenna of claim 11, wherein the respective width of the upper end of each of the four radiators is half of a thickness of the upper end of each of the four radiators.

14. The all metal wideband tapered slot phased array antenna of claim 10, further comprising:

a resonator configured to share a side thereof with the ground plate;

a feeding portion that forms a continuous inclined surface with an inclined surface of a particular one of the four radiators, is spaced apart from the ground plate by a gap, and excites a feeding signal; and a feeding line connected to the particular radiator through the feeding portion to apply the feeding signal to the particular radiator.

* * * * *